US006286802B1

(12) United States Patent
Munson et al.

(10) Patent No.: US 6,286,802 B1
(45) Date of Patent: Sep. 11, 2001

(54) HANGER SYSTEM HAVING BUBBLE LEVEL INSERT

(76) Inventors: Leslie C. Munson, 27751 Horseshoe Bend, San Juan Capistrano, CA (US) 92675; Steve Alan Kumetz, 1817 N. Fuller Ave, #304, Los Angeles, CA (US) 90046; James Milton Gallien, 24164 Lupin Hill Rd., Hidden Hills, CA (US) 91302

( * ) Notice: Subject to any disclaimer, the term of this patent is extended or adjusted under 35 U.S.C. 154(b) by 0 days.

(21) Appl. No.: 09/639,925

(22) Filed: Aug. 16, 2000

Related U.S. Application Data

(63) Continuation of application No. 09/328,697, filed on Jun. 6, 1999, now abandoned.

(51) Int. Cl.[7] ..... A47G 1/16

(52) U.S. Cl. ..... 248/475.1; 248/542

(58) Field of Search ..... 248/475.1, 489, 248/495, 542, 496

(56) References Cited

U.S. PATENT DOCUMENTS

| | | |
|---|---|---|
| 4,228,982 | 10/1980 | Sellera . |
| 4,597,554 | 7/1986 | James . |
| 4,712,761 | 12/1987 | Wassell . |
| 5,303,895 | 4/1994 | Hart . |
| 5,802,729 | 9/1998 | O'Brien . |

*Primary Examiner*—Ramon O. Ramirez
(74) *Attorney, Agent, or Firm*—Stetina Brunda Garred & Brucker

(57) ABSTRACT

A hanger system comprising a first track attachable to an object and a second track attachable to a wall. The second track includes a level which will indicate a level orientation of the track. The first track and the second track can cooperatively engage one another such that the object will be secured in a level orientation on the wall with the first and second tracks.

8 Claims, 2 Drawing Sheets

HANGER SYSTEM HAVING BUBBLE LEVEL INSERT

This application is a continuation of U.S. patent application Ser. No. 09/328,697, filed Jun. 6, 1999, now abandoned.

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to hanging systems and more particularly to a hanging system that facilitates securing large objects to a wall in a level (i.e., horizontal) orientation.

Typically, frames are secured to a wall by inserting a nail into the wall and then hanging the frame over the nail. The frame is hung on the nail through the use of either a wire and/or bracket attached to the frame, or the frame itself is simply supported on the nail. For most frames, it is common to simply insert a single nail as an attachment point and then hang the artwork thereon. To provide an aesthetic appearance, the frame is usually orientated so that the horizontal members of the frame are level. The frame may be leveled by either using a level gauge or adjusting the frame until it appears level to the eye (i.e., eye-balling). Since, the picture is secured with only one nail, it is a simple procedure to level by simply tilting the frame on the nail.

However, the above-mentioned procedure is inadequate for securing large objects (e.g., mirrors, large artwork, cabinets, etc. . . ) to the wall. In that instance brackets, nails, and/or screws are used to secure the heavy object to the wall. A series of nails or screws are inserted into the wall and the large object is hung on the screw and nail heads. In order to ensure that the object is level, the screws or nails must be inserted into the wall in a level (i.e., horizontal) series which can be time consuming and difficult.

Large objects may also be secured to the wall through the use of a bracket system. The bracket system comprises a wall track that is mounted to the wall and a complementary object track that is mounted to the object to be hung. The wall track is an elongate section of material having a longitudinal axis and two parallel longitudinal sides spaced about 1½ inches from one another. The wall track is angled or bent along the longitudinal axis thereof to form an attachment portion and a hanging portion. The attachment portion contains a series of openings for inserting a screw or nail therein and securing the wall track to the wall. Specifically, the attachment portion is secured to the wall by inserting a screw or nail through a respective opening such that the attachment portion is in substantially laminar juxtaposition with such wall. As mentioned above, the hanging portion is angled or bent such that a gap or space is formed between the hanging portion and the wall. The wall track is mounted to the wall such that hanging portion is above the attachment portion.

The object track is similar to the wall track and has a longitudinal axis with two parallel longitudinal sides spaced about 1½ inches from one another. The object track is angled or bent along the longitudinal axis thereof to form an attachment portion and a hanging portion. The attachment portion of the object track additionally has a series of openings formed therein for attachment of the object track to the object to be hung. The attachment portion, when secured to the object, will be in laminar juxtaposition with the object. The attachment portion will be angled away from such object when attached thereto. The object track is attached to the object such that a gap is formed between the hanging portion and the object.

In order to hang the object, the hanging portion of the object track is inserted between the hanging portion of the wall track and the wall (i.e., the gap created between the hanging portion of the wall track and the wall). The object is lowered such that the wall track hanging portion supports the object track hanging portion. Therefore, the object is secured to the wall with the wall track and the object track.

The length of the wall track and the object track is determined by the size of the object to be hung. For example, when hanging a cabinet, the tracks may be sized to extend the total length of the cabinet. By using tracks that extend the total length of the cabinet, the tracks are able to support the total weight of the cabinet. In this respect, the tracks may be in excess of six feet thereby making them awkward to handle and difficult to install in a level orientation.

In order to ensure that the object to be hung is level, the wall track must be in a level orientation when attached to the wall. As mentioned above, the track may be over six feet in length, thereby making such leveling procedure difficult. The wall track is leveled by either aligning the track to a level chalk line marked on the wall, or by leveling the wall track with a level gauge prior to securement to the wall. Either procedure is time consuming, prone to error and typically requires at least two people to accomplish.

Prior art hanging systems have included built in bubble levels to facilitate attachment and proper leveling of pictures on walls. U.S. Pat. No. 5,209,449 for Apparatuses and Methods for Hanging Frames discloses a bracket that is attached to a wall and can support the channel of a standardized metallic frame or picture hanger. The bracket includes a spirit (bubble) level that facilitates leveling of the bracket. The bracket is sized to hang small frames to the wall and therefore cannot support large objects such as cabinets or mirrors. Additionally, the bracket is formed only to engage standardized metallic frames and picture hangers and therefore would not be suitable for other types of objects such as cabinets.

The present invention addresses the above-mentioned deficiencies in the prior art hanging devices by providing a hanging system that accurately and quickly secures large objects to a wall. In this respect, the hanging system of the present invention can be installed by a single person. Additionally, the hanging system of the present invention is easy to manufacture and relatively inexpensive.

BRIEF SUMMARY OF THE INVENTION

In accordance with the preferred embodiment of the present invention there is provided a hanger system for securing an object to a vertical support surface or wall. The system comprises an object track that defines a first longitudinal axis and has a first attachment portion and a first hanging portion extending angularly relative to the first attachment portion. The first attachment portion is engagable to the object. The hanger system further comprises a wall track that defines a second longitudinal axis. The wall track has a second attachment portion engagable to the vertical support surface and a second hanging portion extending angularly relative to the second attachment portion. Additionally, the wall track includes a channel portion extending along at least one of the second hanging and second attachment portions. The channel portion is configured to define a slot. The hanger system further includes a leveling device such as a spirit or bubble level. The leveling device is insertable into the slot and configured to indicate a level orientation of the second track when engaged to the vertical support surface. Therefore, in order to use the hanger system, the first hanging portion is configured to cooperatively engage the second hanging portion such that the first longitudinal axis is generally parallel to the level second longitudinal axis.

The object track is configured to have an outer side and an inner side. The inner side of the object track is partially engagable to the object. Correspondingly, the wall track has an outer side and an inner side partially engagable to the vertical support surface. The inner side of the wall track is partially engagable to the vertical support surface. In the preferred embodiment of the present invention, the inner side of the object track is partially engagable to the inner side of the wall track. Typically, the channel portion extends along the outer side of the wall track between the second attachment portion and the second hanging portion.

The hanging system is used by attaching the first attachment portion of the object track to the object. Next, the wall track is positioned in a level orientation on the vertical support surface with the aid of the level. The second attachment portion of the wall track is then attached to the wall. The first hanging portion is then cooperatively engaged to the second hanging portion such that the object is secured to the vertical support structure in a level orientation.

BRIEF DESCRIPTION OF THE DRAWINGS

These as well as other features of the present invention, will become more apparent upon reference to the drawings wherein.

DETAILED DESCRIPTION OF THE INVENTION

Figures 1, 2, 3:
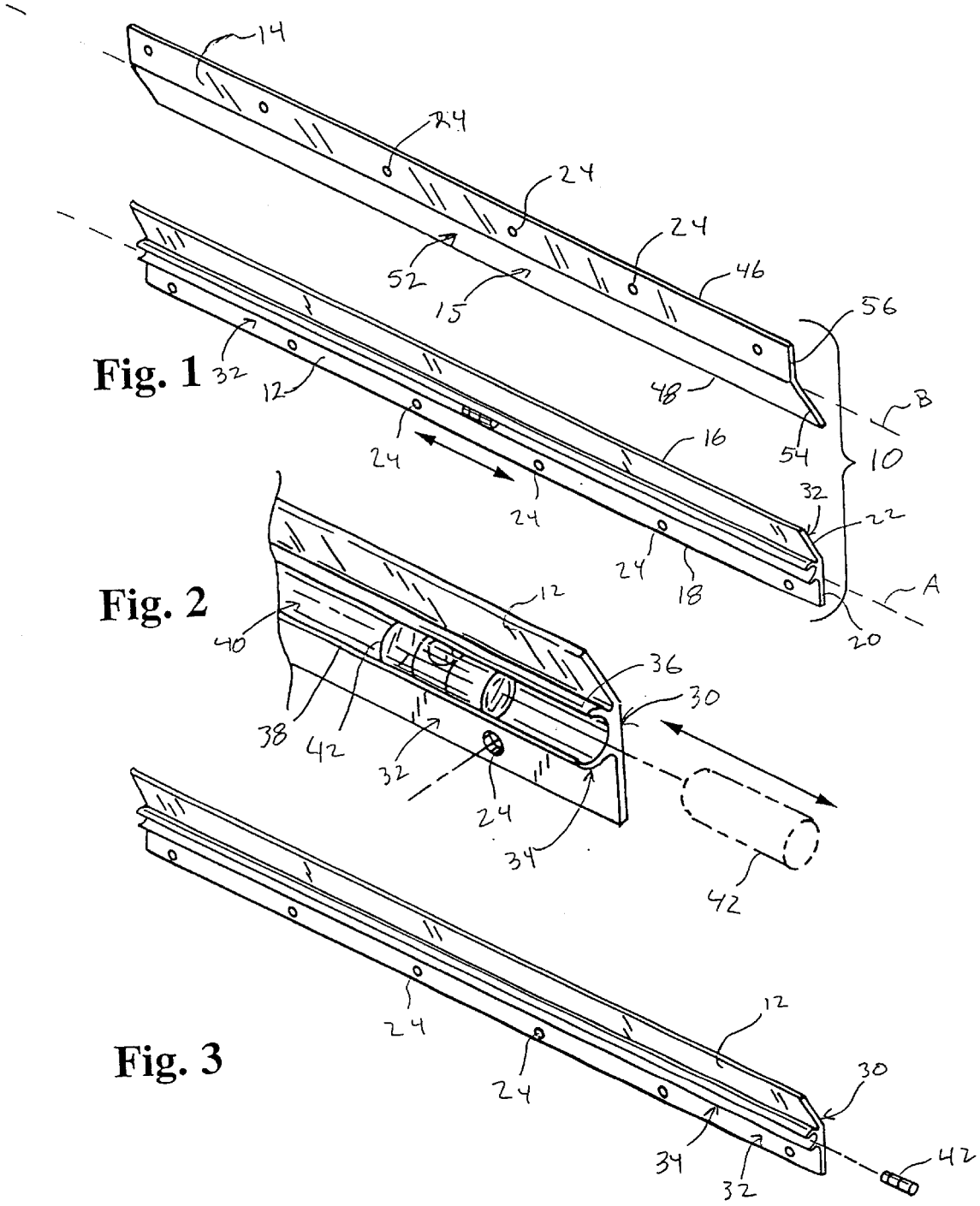
FIG. 1 is an exploded view of the hanger system constructed in accordance with the present invention, illustrating the wall track and object track components thereof.
FIG. 2 is a partial perspective view of the wall track of the present hanger system having a level gauge operatively inserted therein.
FIG. 3 is a perspective view of the wall track of the present hanger system illustrating the manner in which the level gauge is inserted therein.

Referring now to the drawings wherein the showings are for purposes of illustrating a preferred embodiment of the present invention only, and not for purposes of limiting the same, FIG. 1 perspectively illustrates a hanger system 10 constructed in accordance with the preferred embodiment of the present invention and used to secure large items to a vertical support surface such as a wall. The hanger system 10 comprises a first or wall track 12 and a second or object track 14.

The wall track 12 is formed from an elongate rectangular section of metallic material having a lateral width of approximately 1.5 inches. The wall track 12 may be formed from longitudinally extruded aluminum and cut to any length desired as will be further explained below. As will be recognized to those of ordinary skill in the art, the wall track 12 may alternatively be formed from any substantially rigid material such as plastic/vinyl extrusions. The wall track 12 has a top edge 16 and a bottom edge 18 which extend longitudinally along the length thereof. Both the top edge 16 and bottom edge 18 extend in spaced, substantially parallel relation to a longitudinal axis "A", as seen in FIG. 1. Additionally, the wall track 12 has an outer side 32 and an inner side 30, a portion of which is abuttable against a vertical support surface such as a wall 28 as will be further explained below. The wall track 12 is angled or bent to thereby define a lower attachment portion 20 and an upper attachment portion 22. The wall track 12 is angled or bent approximately midway between the top edge 16 and the bottom edge 18 along longitudinal axis "A". The lower attachment portion 20 of wall track 12 includes a series of openings 24 formed therein for insertion of a fastener 26. The series of openings 24 are parallel to axis "A" and equally spaced therefrom. Additionally, each opening 24 is equally spaced approximately four inches from an adjacent opening 24 which allows the wall track 12 to be secured to wall studs placed at standard sixteen inch intervals.

Figure 4A:
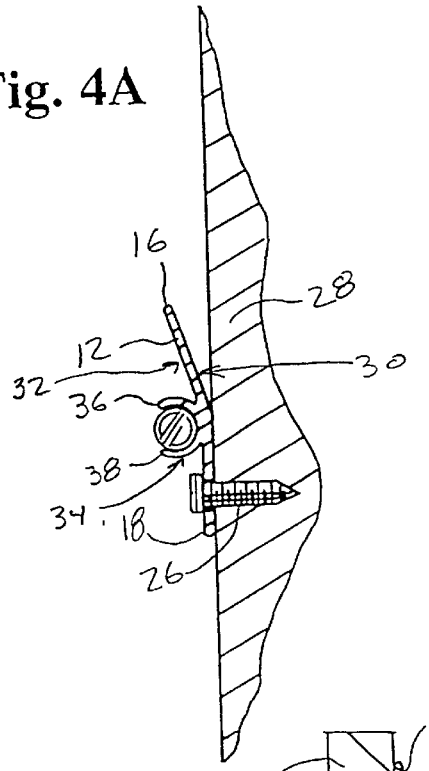
FIG. 4A is a cross-sectional view illustrating the manner in which the wall track of the present hanger system is attached to a vertical support surface.

As seen in FIGS. 2,3 and 4A, the wall track 12 has a channel portion 34 formed on and extending along the outer side 32 thereof. The channel 34 portion is disposed along longitudinal axis "A" and is substantially parallel to the top edge 16 of wall track 12. The channel portion 34 has a substantially "C" shaped cross-sectional configuration with a curved top lip 36, a curved bottom lip 38 and a slot 40 defined therebetween. As seen in FIG. 4A, the distal edges of the top lip 36 and the bottom lip 38 do not contact each other, but rather are separated such that a relatively wide gap is defined therebetween.

The slot 40 is sized to accept a bubble or spirit level 42. The spirit level 42 is a cylindrical chamber containing fluid and a gas bubble. As will be recognized, the spirit level 42 determines a level (horizontal) position when the gas bubble is centered between the two stripes formed on the chamber. As seen in FIG. 2, the spirit level 42 is slidable within the slot 40. In this respect, the spirit level 42 is sized slightly smaller than the slot 40 such that the spirit level 42 may be maintained therein. As seen in FIG. 2, the gap between the top lip 36 and the bottom lip 38 allows the gas bubble within the spirit level 42 to be viewable.

Figure 4B:
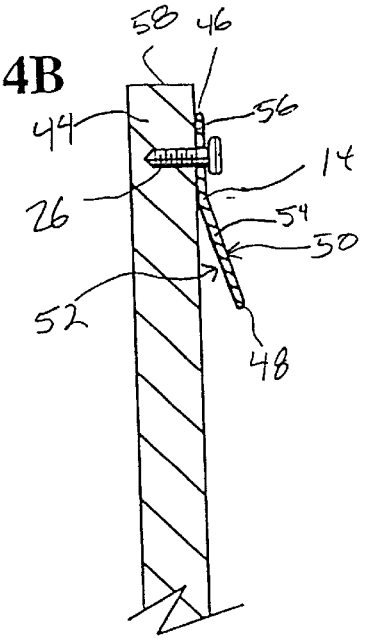
FIG. 4B is a cross-sectional view illustrating the manner in which the object track of the present hanger system is attached to a structure to be suspended upon the vertical support surface.

The object track 14 is complementary to the wall track 12 and is attached to an object 44 such as a large picture, mirror or cabinet as seen in FIG. 4B. The object track 14 is formed from an elongate rectangular section of extruded metallic material such as aluminum. Alternatively, the object track 14 may be formed from a plastic/vinyl extrusion. The object track 14 has a top edge 46 and a bottom edge 48 which extend longitudinally along the length of the object track 14. Both the top edge 46 and the bottom edge 48 extend in spaced, substantially parallel relation to a longitudinal axis "B" of the object track 14 as seen in FIG. 1. The object tract 14 further includes an outer side 50 and an inner side 52, a portion of which is in abutting contact with the object 44 when the, object track 14 is attached thereto. The object track 14 is angled or bent along longitudinal axis "B" to thereby define a lower hanging portion 54 and an upper attachment portion 56 as seen in FIG. 1. As seen in FIG. 4B, the lower hanging portion 54 of object track 14 is angled away from object 44 when secured thereto.

The upper attachment portion 56 of object track 14 includes a series of openings 24 formed for the insertion of a respective fastener 26 therethrough. The openings are spaced approximately four inches apart and are generally parallel to the longitudinal axis "B" of object track 14. Additionally, the width of the upper attachment portion 56 may be smaller than the width of the lower hanging portion 54 since the object track 14 does not contain a channel portion like the channel portion 34.

The hanger system 10 is used by first securing the wall track 12 to wall 28 in a level (horizontal) orientation. Specifically, the spirit level 42 is inserted into the slot 40 and the inner side 30 of lower attachment portion 20 is placed in laminar juxtaposition with the wall 28. The spirit level 42 will indicate when the top edge 16 of wall track 12 is level. When the top edge 16 is level, the wall track 12 is secured to the wall with at least one fastener 26 extending through a respective opening 24.

The spirit level 42 disposed within channel 34 allows the wall track 12 to be secured to the wall 28 by one person. In a preferred attachment technique, a first fastener 26 is inserted through a respective ones of the openings 24 and into the wall 28. Since the fastener 26 is only partially inserted into the wall 28, the wall track 12 can pivot about such fastener 26 until a level orientation is indicated by spirit level 42. Once in a level orientation, a second fastener 26 can be inserted through another one of the openings 24 and into the wall 28. This procedure is especially useful for installing wall tracks 12 since one end of the wall track 12 is supported by the first fastener while the wall track 12 is being leveled.

The object track 14 is attached to the object 44 in a similar manner. In order to ensure that the object 44 is level when attached to the wall 28 with the hanger system 10, the object track 14 must be secured to object 44 in a position whereby the object 44 will appear to be level when attached to the wall 28. Therefore, the object track 14 is positioned near a top surface 58 of object 44. In this respect, the top edge 46 of object track 14 is aligned with the top surface 58 of object 44 such that when the object is secured to wall 28 with hanger system 10, the top surface 58 of object 44 will be level. The object track 14 can be aligned with the top surface 58 by either eyeballing such or by measuring a prescribed distance down from the top surface 58 of object 44 and then attaching the wall track 14 at this prescribed distance. As will be recognized by those of ordinary skill in the art, it is also possible to include a channel portion like the channel portion 34 in the object track 14 such that a spirit level 42 can be used to facilitate alignment and attachment of the object track 14 to the object 44. Once the object track 14 is secured to the object 44 and the wall track 12 is secured to the wall 28, the object 44 can be hung on wall 28.

Figure 4C:
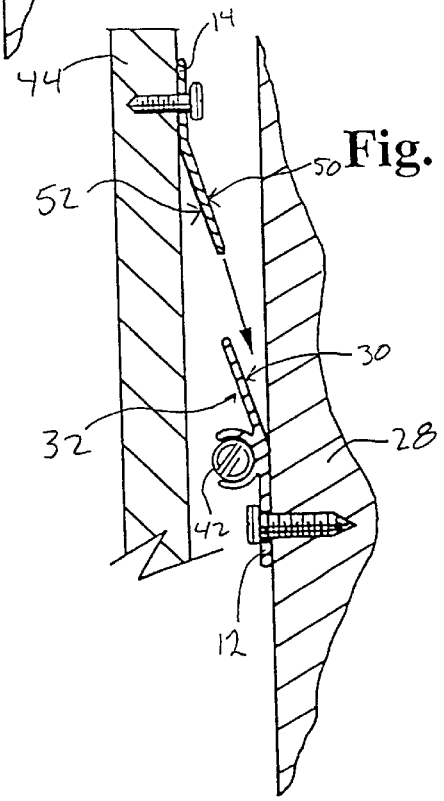
FIGS. 4C and 4D are a cross-sectional views illustrating the manner in which the wall and object tracks of the present hanger system are cooperatively engaged to each other.
Figure 4D:
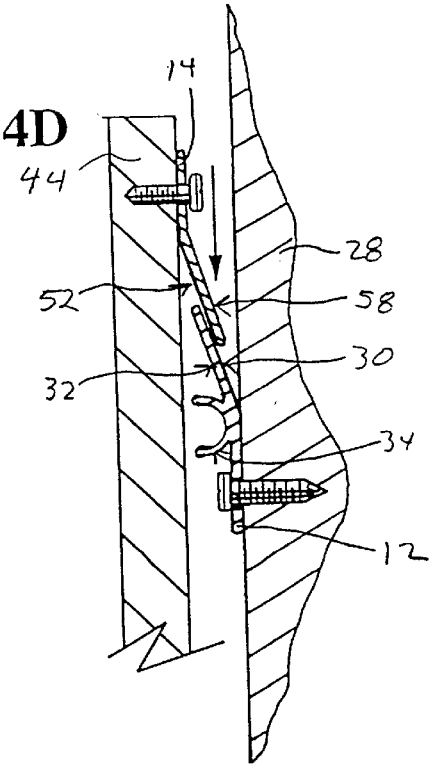

As seen in FIG. 4C, the object 44 is hung on the wall 28 by positioning the object track 14 above the wall track 12. The object track 14 is then slid downward toward the wall track 12 until the inner side 52 of the object track 14 is in laminar juxtaposition (i.e., abutting contact) with the inner side 30 of wall track 12. As seen in FIG. 4D, as the object 44 is slid downward, the mating between the inner side 52 of object track 14 and inner side 30 of object track 12 draws the object 44 and the wall 28 together. The object 44 is secured to the wall 28 when the bottom edge 48 is positioned adjacent to the lower attachment portion 20 of wall track 12. The junction formed between the wall track 12 and the wall 28 supports the bottom edge 48 of the object track 14. The bottom edge 48 of object track 14 is supported in a level orientation since the wall track 12 was mounted level on wall 28. Therefore, the object track 14 will be level, as will the object 44 secured thereto.

Since the object track 14 is supported by the wall track 12, typically the length of the object track 14 and the wall track 12 are substantially equal and sized appropriately to support the object 44. For example, when hanging a cabinet, the object track 14 will extend the full length of such cabinet in order to provide the necessary support for securement to the wall 28. As will be recognized, the engagement between the object track 14 and the wall track 12 allows the object 44 to be movable laterally along the wall 28 and still be positioned in a level orientation. In this respect, it is possible to position object 44 in the correct lateral position on wall 28 by sliding the object, yet still maintain the level orientation of the object 44. Typically, if the object 44 is to be positioned laterally on the wall track 12, the length of the wall track 12 will be smaller than the length of the object track 14 so that the object track 14 is not viewable from the sides of the object 44.

As will be recognized to those of ordinary skill in the art, the spirit level 42 may be reused for other hanger systems 10. For instance, once the wall track 12 has been installed on the wall 28, the spirit level 42 may be removed from slot 40 and reused on a second wall track 12. The spirit level 42 is therefore reusable such that the spirit level 42 is only purchased initially and used on multiple wall tracks 12.

Additional modifications and improvements of the present invention may also be apparent to those of ordinary skill in the art. Thus, the particular combination of parts described and illustrated herein is intended to represent only a certain embodiment of the present invention, and is not intended to serve as limitations of alternative devices within the spirit and scope of the invention.

What is claimed is:

1. A hanger system for securing an object to a vertical support surface, the system comprising:

a) an elongate rigid first structure sizeable to a desired length and having a first-structure attachment plane attachable to the object and an angularly protruding first-structure engagement plane, said first-structure attachment and engagement planes extending substantially the entire length of said first structure;

b) an elongate rigid second structure sizeable to a desired length and having a second-structure attachment plane attachable to the vertical support structure and an angularly protruding second-structure engagement plane, said second-structure attachment and engagement planes extending substantially the entire length of said second structure and whereby said first-structure and said second-structure engagement planes are engageable with each other for hanging the object on the wall;

c) a retainer structure extending the length of the second structure along a single continuous plane, said retainer structure exteriorly accessible along the entire length thereof; and d) a spirit level slidingly and removably situated within the retainer structure and exteriorly visible along the entire length of said retainer structure for permitting the positioning and hanging of the second structure in a level configuration on said vertical support.

2. A hanger system as claimed in claim 1 wherein both the first-structure attachment and engagement portions are flat and wherein both the second-structure attachment and engagement portions are flat.

3. A hanger system as claimed in claim 2 wherein the first-structure engagement portion is juxtapositionally placeable over the second-structure engagement portion for engaging each other.

4. A hanger system as claimed in claim 1 wherein the retainer structure is a slot having a C-shape as viewed from an end thereof.

5. A hanger system as claimed in claim 1 wherein both the first and second structures are placeable to reside behind the object upon hanging said object on the vertical support surface.

6. A hanger system as claimed in claim 1 wherein both the first and second structures are fabricated of an extruded material.

7. A hanger system as claimed in claim 6 wherein the extruded material is aluminum.

8. A hanger system as claimed in claim 6 wherein the extruded material is plastic.

* * * * *